US010184736B2

(12) United States Patent
Fumia et al.

(10) Patent No.: US 10,184,736 B2
(45) Date of Patent: Jan. 22, 2019

(54) FRAME SLIDE GUIDE SYSTEM

(71) Applicant: American Classic Arms, LLC, Wayland, NY (US)

(72) Inventors: David Theodore Fumia, Rochester, NY (US); Ronald Herman Kohlstaedt, Wayland, NY (US)

(73) Assignee: American Classic Arms, LLC, Wayland, NY (US)

( * ) Notice: Subject to any disclaimer, the term of this patent is extended or adjusted under 35 U.S.C. 154(b) by 0 days.

(21) Appl. No.: 15/410,217

(22) Filed: Jan. 19, 2017

(65) Prior Publication Data

US 2017/0205163 A1 Jul. 20, 2017

Related U.S. Application Data

(60) Provisional application No. 62/280,464, filed on Jan. 19, 2016.

(51) Int. Cl.

| | |
|---|---|
| ***F41A 3/64*** | (2006.01) |
| ***F41A 3/66*** | (2006.01) |
| ***F41C 3/00*** | (2006.01) |
| ***F41A 5/02*** | (2006.01) |

(52) U.S. Cl.

CPC *F41A 3/66* (2013.01); *F41A 5/02* (2013.01); *F41C 3/00* (2013.01)

(58) Field of Classification Search

CPC ..... F41C 3/00; F41C 3/64; F41C 3/66; F41C 23/10; F41C 23/16

See application file for complete search history.

(56) References Cited

U.S. PATENT DOCUMENTS

| | | | | | |
|---|---|---|---|---|---|
| 1,363,040 | A * | 12/1920 | Hammond | F41A 3/46 | 42/25 |
| 1,382,197 | A * | 6/1921 | Jolidon | F41A 3/68 | 42/75.01 |
| 2,127,793 | A * | 8/1938 | Walther | F41A 3/66 | 42/106 |
| 3,636,648 | A * | 1/1972 | Spencer | F41A 3/64 | 42/16 |
| 4,463,655 | A * | 8/1984 | Krieger | F41C 27/00 | 89/196 |
| 4,593,601 | A * | 6/1986 | Smith | F41A 3/82 | 89/196 |
| 5,033,217 | A * | 7/1991 | Brennan | F41A 3/64 | 42/1.01 |
| 5,669,169 | A * | 9/1997 | Schmitter | F41A 3/66 | 42/71.02 |

(Continued)

*Primary Examiner* — Derrick R Morgan

(74) *Attorney, Agent, or Firm* — Brian B. Shaw, Esq.; Alfred Y. Chu, Esq.; Harter Secrest & Emery LLP

(57) ABSTRACT

The present disclosure presents a firearm. The firearm includes a frame having a handle and a slide rail guide, the slide rail guide comprising two parallel grooves extending through a long axis of the frame, and a slide having a long axis, the slide comprising two parallel slide rails extending through the long axis of the slide, the two parallel slide rails operable for slidably engaging the two parallel grooves. The firearm also includes a first spacer, the first spacer fixedly attached to one of the frame and the slide, the first spacer operable to slidably engage the slide rails and the slide rail guide providing a first gap between one of the slide rails and the one of the grooves and a second spacer.

8 Claims, 7 Drawing Sheets

(56) References Cited

U.S. PATENT DOCUMENTS 5,717,156 A * 2/1998 Lenkarski ..... F41A 3/64 42/15
5,741,996 A * 4/1998 Ruger ..... F41A 3/66 42/16
6,430,860 B1 * 8/2002 Constant ..... F41A 9/65 42/84
6,557,289 B2 * 5/2003 Stall ..... C22C 21/10 42/71.02
6,718,680 B2 * 4/2004 Roca ..... F41A 9/45 42/14
6,789,342 B2 * 9/2004 Wonisch ..... F41A 3/64 42/70.02
6,993,864 B1 * 2/2006 O'Clair ..... F41A 3/14 42/71.02
7,392,611 B2 * 7/2008 Curry ..... F41A 11/00 42/106
7,472,507 B2 * 1/2009 Curry ..... F41A 19/15 42/14
8,935,871 B2 * 1/2015 Bardy ..... F41A 19/14 42/69.03
9,068,793 B1 * 6/2015 Barrett ..... F41C 23/16
9,696,102 B2 * 7/2017 Lee ..... F41A 3/38
9,791,224 B1 * 10/2017 Russo ..... F41A 3/66
9,874,417 B2 * 1/2018 Zajk ..... F41A 17/56
9,927,200 B2 * 3/2018 Kuracina ..... F41A 19/30
2004/0007124 A1 * 1/2004 Nakatani ..... F41A 3/64 89/196
2005/0188585 A1 * 9/2005 Vicate ..... F41C 3/00 42/71.01
2007/0084101 A1 * 4/2007 Pikielny ..... F41A 3/66 42/71.01
2010/0037504 A1 * 2/2010 Muller ..... F41A 3/66 42/90
2012/0017481 A1 * 1/2012 Settles ..... B32B 15/01 42/25
2012/0260553 A1 * 10/2012 Gnesda ..... F41A 3/26 42/16
2013/0036644 A1 * 2/2013 Bardy ..... F41A 3/64 42/69.03
2014/0165442 A1 * 6/2014 Nebeker ..... F41A 3/64 42/16
2015/0059221 A1 * 3/2015 Bero ..... F41A 3/66 42/16
2015/0276335 A1 * 10/2015 Daley, Jr. ..... F41A 3/66 42/75.01
2015/0316336 A1 * 11/2015 Lee ..... F41A 3/38 42/16
2016/0178309 A1 * 6/2016 Drake ..... F41A 35/06 42/14
2016/0209137 A1 * 7/2016 DeSomma ..... F41A 3/82
2016/0356568 A1 * 12/2016 Kuracina ..... F41A 19/30
2016/0377360 A1 * 12/2016 Giesen ..... F41A 11/02 42/25
2017/0122684 A1 * 5/2017 Drake ..... F41A 11/02
2017/0321980 A1 * 11/2017 Wolf ..... F41A 11/02
2017/0356703 A1 * 12/2017 Daley, Jr. ..... F41G 11/003
2018/0010889 A1 * 1/2018 Zimmer ..... F41G 11/001
2018/0031341 A1 * 2/2018 Bubits ..... F41A 3/14
2018/0087854 A1 * 3/2018 Gray ..... F41A 5/28

* cited by examiner

FRAME SLIDE GUIDE SYSTEM

BACKGROUND OF THE INVENTION

Field of the Invention

The present disclosure relates to a firearm with a slide and frame. The present disclosure relates more particularly to a firearm with reduced jamming.

Description of Related Art

There are three common types of handguns: single-shot pistols, revolvers, and semi-automatic pistols. Semi-automatic pistols have a single fixed firing chamber machined into the rear of the barrel, and a magazine so they can be used to fire more than one round. Each press of the trigger fires a cartridge, using the energy of the cartridge to activate the mechanism so that the next cartridge may be fired immediately.

A pistol is a type of handgun that typically has one chamber integral with the barrel. A semi-automatic pistol delivers fast rates of fire and requires only a few second to reload. In blowback-type semi-automatics, the recoil force is used to push the slide back and eject the shell so that the magazine spring can push another round up, then as the slide returns, it chambers the round.

BRIEF SUMMARY OF THE INVENTION

In view of the foregoing, it is an object of the present disclosure to provide a firearm and a method of providing.

A first exemplary embodiment of the present disclosure provides a gun. The gun includes a frame extending along a longitudinal direction, the frame having a frame first side and a frame second side perpendicular to the longitudinal direction, one of the frame first side and the frame second side including a frame primary longitudinal sliding interface, and a slide configured to slidingly engage the frame, the slide having a slide first side and a slide second side perpendicular to the longitudinal direction, one of the slide first side and the slide second side including a slide primary longitudinal sliding interface, the slide primary longitudinal sliding interface being complementary to the frame primary longitudinal sliding interface. The gun further includes a first contact pad extending a sufficient distance perpendicular to the longitudinal direction from one of the frame primary longitudinal sliding interface and the slide primary longitudinal sliding interface to contact a remaining one of the frame primary longitudinal sliding interface and the slide primary longitudinal sliding interface.

A second exemplary embodiment of the present disclosure provides a firearm assembly. The firearm assembly includes a frame comprising a handle and a slide rail guide, the slide rail guide comprising two parallel grooves extending through a long axis of the frame, and a slide having a long axis, the slide comprising two parallel slide rails extending through the long axis of the slide, the two parallel slide rails operable for slidably engaging the two parallel grooves. The firearm assembly further includes a first spacer, the first spacer fixedly attached to one of the frame and the slide, the first spacer operable to slidably engage the slide rails and the slide rail guide providing a first gap between one of the slide rails and the one of the grooves, and a second spacer, the second spacer operable to slidably engage the slide rails and the slide rail guide providing a second gap between the remaining one of the slide rails and the remaining one of the grooves.

A third exemplary embodiment of the present disclosure provides a method includes (a) providing a frame comprising a handle and a slide rail guide, the slide rail guide comprising two parallel grooves extending through a long axis of the frame, and providing a slide having a long axis, the slide comprising two parallel slide rails extending through the long axis of the slide, the two parallel slide rails operable for slidably engaging the two parallel grooves. The method further includes providing a first spacer, the first spacer fixedly attached to one of the frame and the slide, the first spacer operable to slidably engage the slide rails and the slide rail guide providing a first gap between one of the slide rails and the one of the grooves, and providing a second spacer, the second spacer operable to slidably engage the slide rails and the slide rail guide providing a second gap between the remaining one of the slide rails and the remaining one of the grooves.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

DETAILED DESCRIPTION OF THE INVENTION

Embodiments of the present disclosure provide a gun or firearm having a frame and a slide. Embodiments of the frame and slide are such that the slide can be slidably attached to the frame along a slide rail guide that includes multiple spacers or contact pads that operably form gaps between the frame and the slide along the slide rail guides. Embodiments of the present disclosure further provide a firearm that reduces the occurrence of blockage or jamming based on movement between the frame and the slide by providing cavities that can operably maintain a certain amount of extraneous materials (e.g., dirt, grease, and/or gun residue). The term firearm includes guns, handguns, and pistols, wherein the motive energy can be from chemical or mechanical storage.

Figure 1:
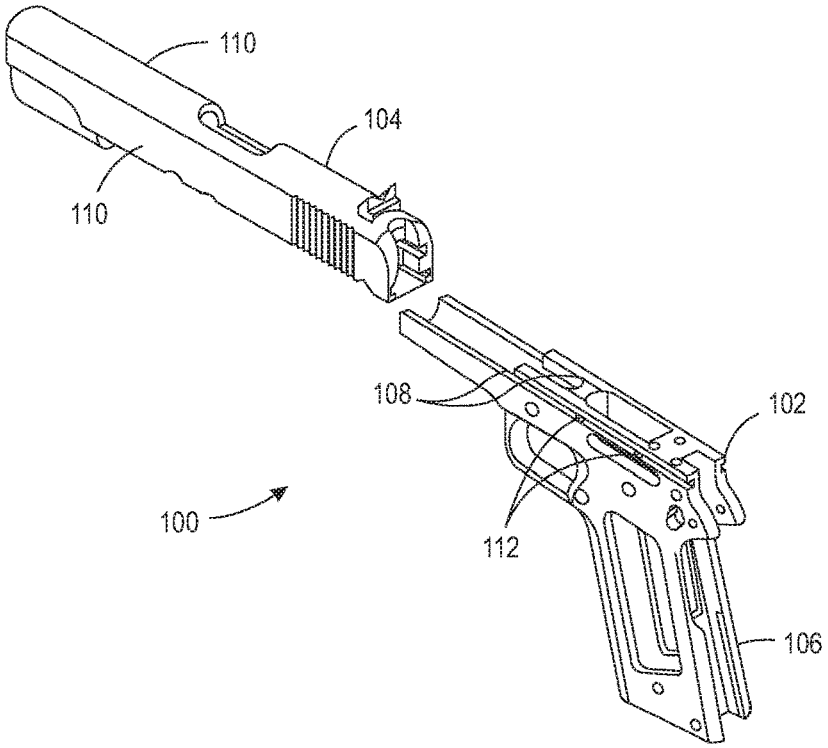
FIG. 1 is a side perspective view of a firearm suitable for practicing exemplary embodiments of the present disclosure.

Referring to FIG. 1, shown is a rear perspective view of a portion of an exemplary gun (or firearm assembly) 100 suitable for practicing exemplary embodiments of this disclosure. Shown in FIG. 1 is frame 102 and slide 104. It should be appreciated that while FIG. 1 only depicts a portion of gun 100, embodiments of the present disclosure are operable with other elements guns including, but not limited to a barrel, hammer, magazine, recoil spring, etc.

Frame 102 includes a handle portion 106 for interaction with a user's hand. Frame 102 also includes a slide rail guides 108 located on each side of frame 102 (a first side and a second side) extending along the long or longitudinal axis of frame 102. Slide rail guides 108 (or frame primary longitudinal sliding interface) includes two parallel grooves extending through the long axis of frame 102 and are sized to interact with slide 104 to allow slide 104 to slidably engage or attach to slide rail guides 108.

Slide 104 is a part of a firearm that moves during the operating cycle of the firearm 100. Slide 104 is operable to movably or slidably attach to frame 102 such that slide 104 can slide along the long axis of frame 104 within slide rail guide 108. Slide 104 includes a slide rail 110 (or slide primary longitudinal sliding interface) corresponding to and for interacting with slide rail guide 108. Slide rail 110 provides two parallel rails extending through the long axis of slide 104.

Figure 8:
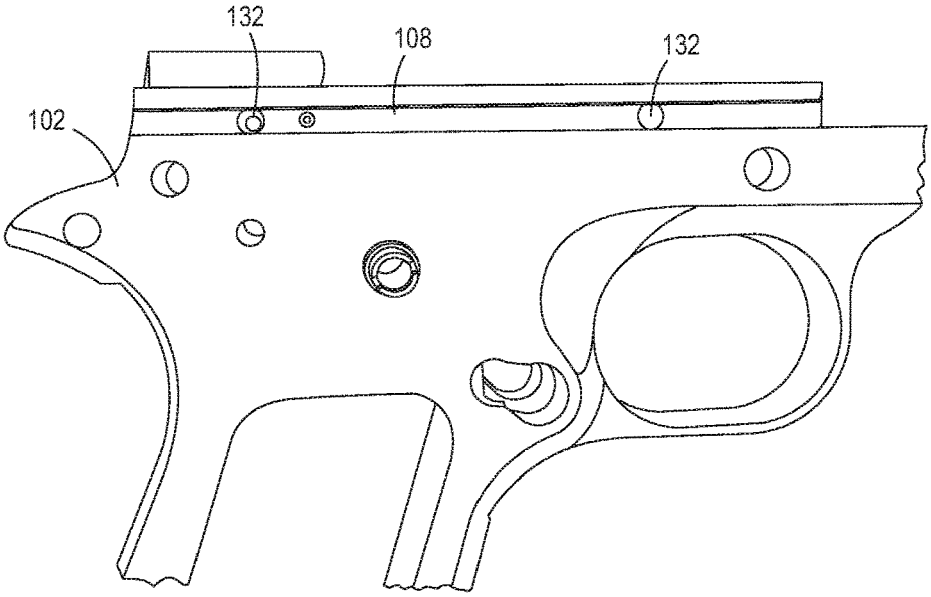
FIG. 8 is a side view of a frame of a firearm suitable for practicing exemplary embodiments of the present disclosure.
Figure 9:
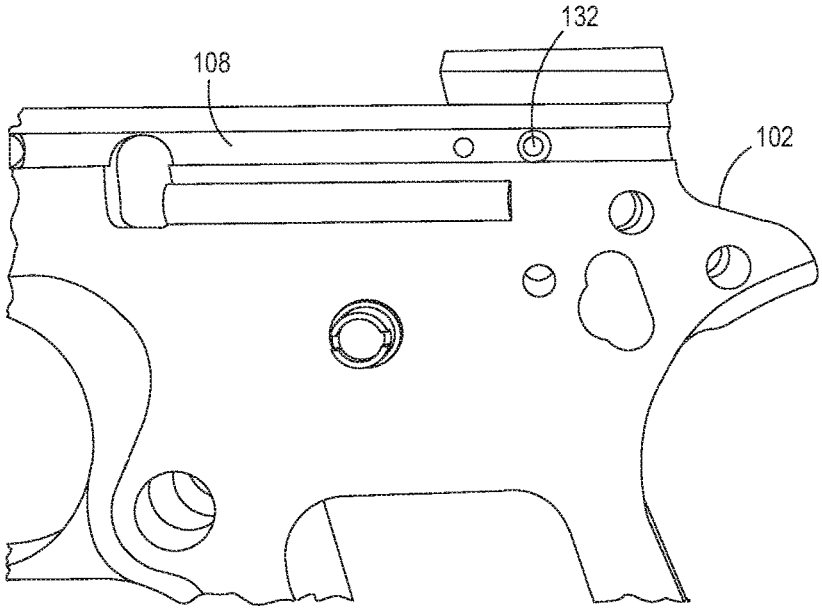
FIG. 9 is a close-up side view of a frame of a firearm suitable for practicing exemplary embodiments of the present disclosure.

Also shown in FIG. 1 is spacer 112 (or contact pad) located on frame 102 within slide rail guides 108. Spacer 112 provides a raised portion from the bottom of grooves of slide rail guides 108. In one embodiment, spacer 112 is a circular pin extending through frame 102 perpendicular to the long axis of frame 102 between the two grooves thus providing spacer 112 within each groove of slide rail guides 108. It should be appreciated that embodiments of the present disclosure include two or more spacers 112 located within slide rail guides 108 thereby providing multiple points of contact between slide 104 and frame 102. Aperture receiving the spacer 112 can extend through the frame to be collinear, as seen in FIG. 8 and FIG. 9. Alternatively, the spacer 112 can be retained in sockets or cavities within the frame 102. There, the spacer 112 can be equally distributed between the left side and the right side of the frame 102, or the spacer 112 can be affixed (along the longitudinal axis) between the left side and the right side of the frame.

In another embodiment, spacer 112 includes a circular pin extending from one of the grooves of slide rail guide 108 and a second pin extending from the other one of the grooves of slide rail guide 108. Thus, in this embodiment, spacer 112 does not extend through frame 102 perpendicular to the long axis of frame 102, but is only extends from and is present on the surface of the grooves of slide rail guides 108. It should be appreciated that embodiments of spacer 112 include any shape or size provided that spacer 112 allows slide rails 110 to interact with slide rail guides 108 allowing slide 104 to movably attach to frame 102, however, spacer 112 maintains a gap (or distance, cavity) between the bottom of the grooves of slide rail guides 108 and slide rails 110.

In yet another embodiment, slide rails 110 can include a spacer 112. In this embodiment, slide rails 110 can include multiple bumps or ribs that extend from the surface of slide rails 110 for interaction and contact with slide rail guides 108.

In still another embodiment, spacers 112 include a first pin fixedly attached to one of the grooves of slide rail guide 108 and a second pin movably attached to the other one of the grooves of slide rail guide 108. The fixed pin establishes a positional relationship between the slide 104 and the frame 102. The second pin is operably movably relative to the bottom of the groove of slide rail guide 108 such that second pin can move laterally perpendicular to the long axis of slide rail guide 108. Also, second pin includes a spring that urges second pin away from the bottom of the groove of slide rail guide 108 and is thus also biased against slide 104 when it is attached to frame 102. Embodiments of spacer 112 include any number of spacer pairs (i.e., spacers 112 that are adjacent to one another on opposite slide rail guides 108) wherein one of the spacer 112 pairs are movable or both are movable relative to slide rail guides 108 in a direction perpendicular to the long axis slide rail guides 108.

Figure 2:
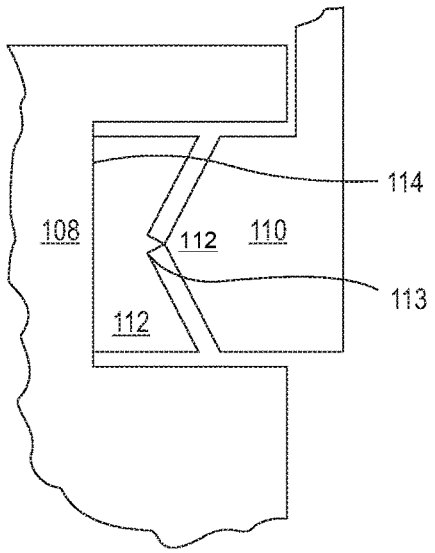
FIG. 2 is a cross sectional view of an exemplary firearm suitable for practicing exemplary embodiments of the present disclosure.

Referring to FIG. 2, shown is a cross sectional view of the interaction between slide rail guide 108, spacer 112 and slide rail 110. Shown in FIG. 2 is slide rail guide 108 with groove 114 extending along the long axis of frame 102. Within groove 114 is spacer 112, which extends from the surface of groove 114 and is in contact with slide 104 at slide rail 110. It should be noted that spacer 112 does not extend completely through groove 114 in slide rail guide 108 but only partially extends through groove 114 such that slide rail 110 can extend partially into slide rail guide 108 allowing slide 104 to slidably attach to frame 102.

As is evident from FIG. 2, the surface of spacer 112 that is in contact with slide rail 110 is a "V" shape and slide rail 110 is a corresponding "V" shape. In one embodiment, the "V" shaped surface of spacer 112 creates a 90-degree angle. In another embodiment, the "V" shaped surface can be anywhere between 1-degree to 90-degrees. Likewise, the "V" shaped surface of slide rail 110 can be anywhere between 1-degree to 90-degree angle. Embodiments of spacer 112 and slide rail 110 are shaped such that they correspond to one another thereby maintain a relative vertical and lateral position between frame 102 and slide 104. That is, the surface of spacer 112 and the surface of slide rail 110 that are in contact with each other are shaped such that they allow slide rail 110 to self-center relative to spacer 112. It should be appreciated that embodiments of slide rail 110 and spacer 112 can include any shape such that the relative vertical and lateral position between frame 102 and slide 104 is maintained. For instance, the surface of spacer 112 that is in contact with slide rail 110 can be a circular shaped and slide rail 110 can have a corresponding circular shape. In another embodiment, the surface of spacer 112 that is in contact with slide rail 110 can be diamond shaped or pointed shaped (shown in FIG. 2). In this embodiment, a pocket or gap is created between spacer 112 and slide rail 110 defined by the height of rib 113.

In a further configuration, each spacer 112 and spring can be a preformed assembly that is affixed to the frame 102. That is, a socket can be provided in the frame 102, wherein the spacer 112/spring assembly is disposed in the socket and retained by mechanical engagement or bonding.

Figure 3:
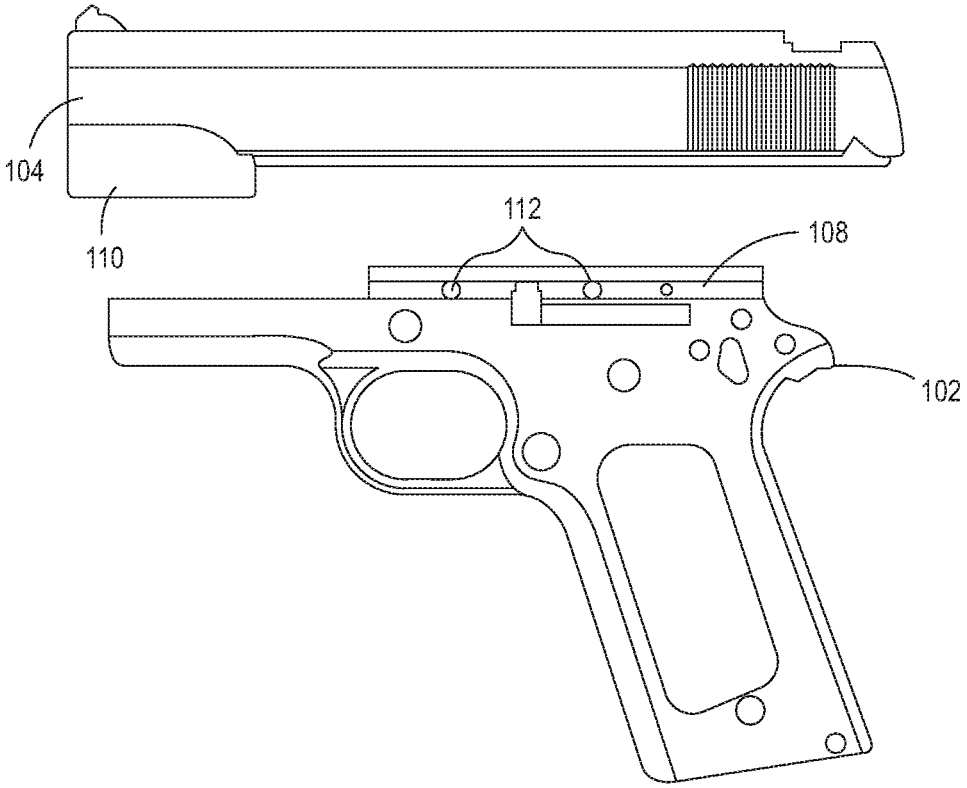
FIG. 3 is a side view of a firearm suitable for practicing exemplary embodiments of the present disclosure.

Reference is now made to FIG. 3, which depicts a side view of portions of an exemplary firearm 100 suitable for practicing exemplary embodiment of this disclosure. Shown in FIG. 3 is frame 102 and slide 104. Frame 102 includes a slide rail guides 108 with two spacers 112. It should be appreciated that while FIG. 2 only depicts two spacers 112, embodiments of the present disclosure contemplate more than two spacers 112 per side of slide rail guide 108 as well as less than two spacers 112 per side of slide rail guide 108. It should be appreciated that embodiments of frame 102 include two or more spacers 112 on one side of rail guide 108 and a different number of spacers 112 on the other side of rail guide 108. For instance, one side of rail guide 108 can include two spacers 112 and the other side of rail guide 108 can include three spacers 112.

Slide 104 includes slide rail 110 for interacting with slide rail guides 108. Slide rails 110 are located along an interior surface of slide 110. Slide rails 110 extend along the long axis of slide 104 parallel to one another and correspond to a width and length operable to interact with slide rail guides 108.

Figure 4:
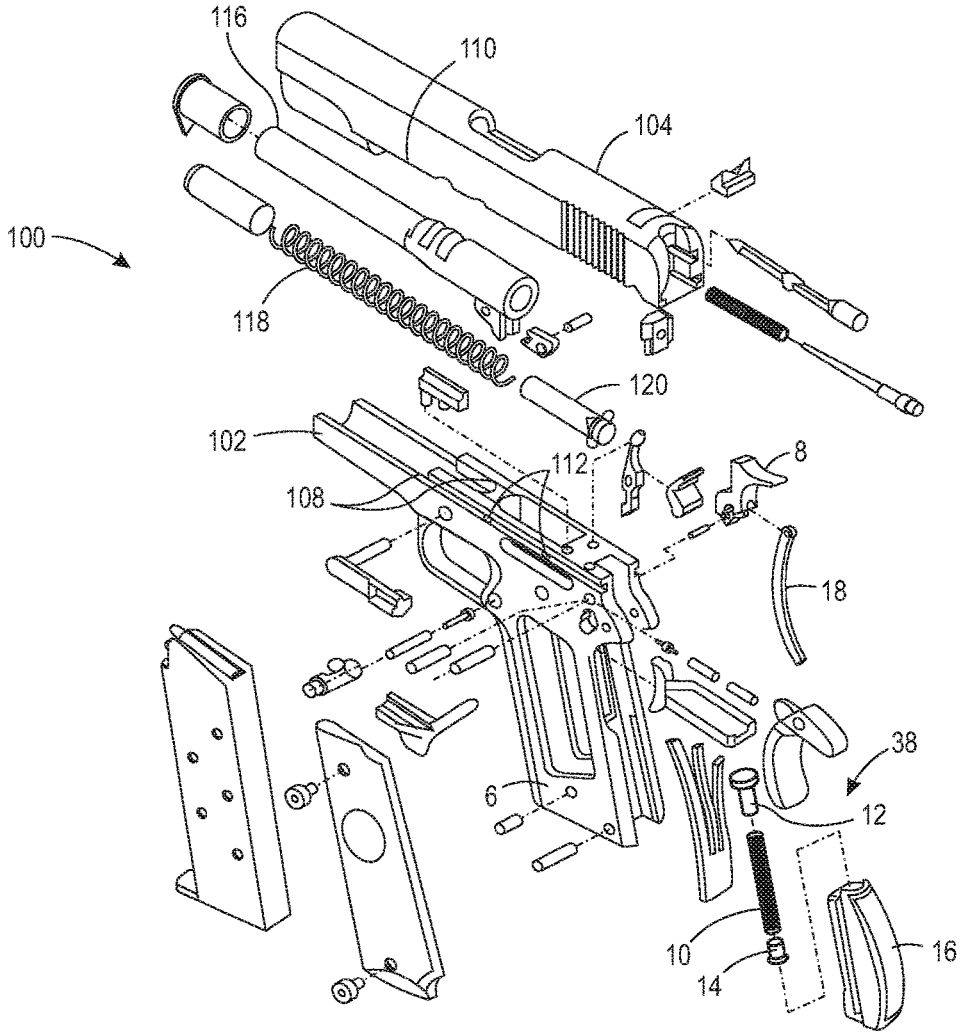
FIG. 4 is an exploded view of a firearm suitable for practicing exemplary embodiments of the present disclosure.

Referring to FIG. 4, shown is an exploded view of an exemplary firearm for practicing exemplary embodiments of the present disclosure. Shown in FIG. 4 is firearm 100 including frame 102, slide 104, barrel 116, recoil spring 118, and recoil spring guide 120. Frame 102 includes slide rail guides 108, which include spacers 112 located within slide rail guides 108. Slide 104 includes slide rails 110 for slidably engaging slide rail guides 108 and spacers 112. It should be appreciated that while embodiments of the present disclosure have been described in reference to a firearm such as an M1911, embodiments of frame 102 having a slide rail guide 108 with spacers 112, or a slide 104 with spacers are applicable to any type of firearm or gun that requires a slide to slidably engage a frame.

Figure 5:
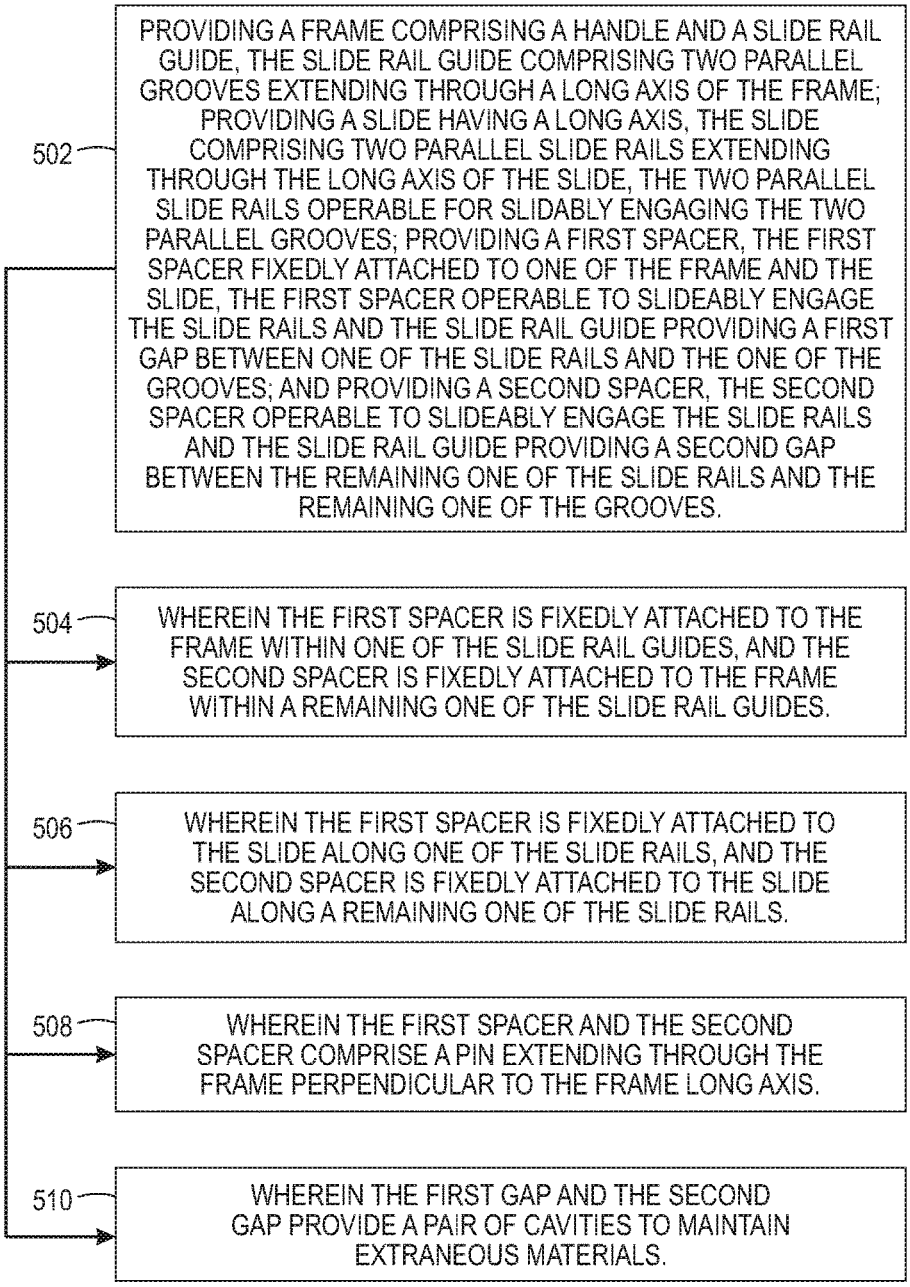
FIG. 5 is a logic flow diagram in accordance with a method and apparatus for performing exemplary embodiments of the present disclosure.

Reference is now made to FIG. 5, which presents a logic flow diagram in accordance with a method and apparatus for performing exemplary embodiments of the present disclosure. Block 502 presents providing a frame comprising a handle and a slide rail guide, the slide rail guide comprising two parallel grooves extending through a long axis of the frame; providing a slide having a long axis, the slide comprising two parallel slide rails extending through the long axis of the slide, the two parallel slide rails operable for slidably engaging the two parallel grooves; providing a first spacer, the first spacer fixedly attached to one of the frame and the slide, the first spacer operable to slidably engage the slide rails and the slide rail guide providing a first gap between one of the slide rails and the one of the grooves; and providing a second spacer, the second spacer operable to slidably engage the slide rails and the slide rail guide providing a second gap between the remaining one of the slide rails and the remaining one of the grooves. Then block 504 relates to wherein the first spacer is fixedly attached to the frame within one of the slide rail guides, and the second spacer is fixedly attached to the frame within a remaining one of the slide rail guides.

Some of the non-limiting implementations detailed above are also summarized at FIG. 5 following block 504. Block 506 specifies wherein the first spacer is fixedly attached to the slide along one of the slide rails, and the second spacer is fixedly attached to the slide along a remaining one of the slide rails. Block 508 then indicates wherein the first spacer and the second spacer comprise a pin extending through the frame perpendicular to the frame long axis. Finally, block 510 states wherein the first gap and the second gap provide a pair of cavities to maintain extraneous materials.

The logic flow diagram may be considered to illustrate the operation of a method or performance of an apparatus or firearm. The logic flow diagram may also be considered a specific manner in which components of a device are configured to cause that device to operate, whether such a device is a firearm, pistol, handgun, barrel, or one or more components thereof.

Figure 6:
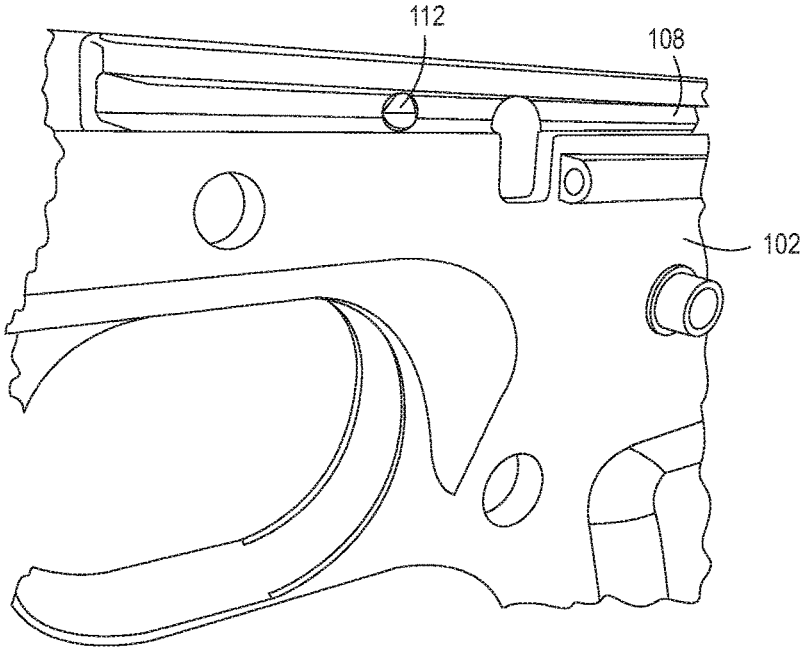
FIG. 6 is a close-up perspective view of a frame of a firearm suitable for practicing exemplary embodiments of the present disclosure.

Referring to FIG. 6, shown is a close-up perspective view of a frame of a firearm suitable for practicing exemplary embodiments of the present disclosure. Shown in FIG. 6 is frame 102, slide rail guide 108 and spacer 112. As is evident from FIG. 6, spacer 112 is "V" shaped. In this embodiment, slide rail 110 will have a corresponding "V" shape so that it fits into spacer 112.

Figure 7:
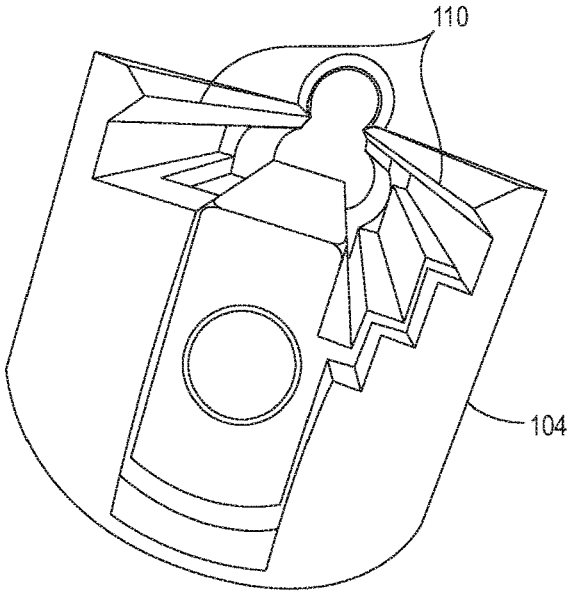
FIG. 7 is a close-up view of a slide of a firearm suitable for practicing exemplary embodiments of the present disclosure.

Referring to FIG. 7, depicted is a close-up view of a slide of a firearm suitable for practicing exemplary embodiments of the present disclosure. Illustrated in FIG. 7 is slide 104 with slide rails 110 for interaction with slide rail guides 108. It should be noted that FIG. 7 shows slide rails 110 having a "V" shaped corresponding to the "V" shaped slide rail guides 108 found in FIG. 6.

Referring to FIG. 8, shown is a side view of a frame of a firearm suitable for practicing exemplary embodiments of the present disclosure. Shown in FIG. 8 is frame 102 with slide rail guide 108. Also shown in FIG. 8 are holes 132 within slide rail guide 108. Holes 132 extend through frame 102 perpendicular to the long axis of slide rail guides 108. Holes 132 are sized and meant to maintain an exemplary spacer 112.

Reference is now made to FIG. 9, which depicts a close-up side view of a frame of a firearm suitable for practicing exemplary embodiments of the present disclosure. Shown in FIG. 9 is frame 102, slide rail guide 108 and hole 132 for maintaining an exemplary spacer 112.

Figure 10:
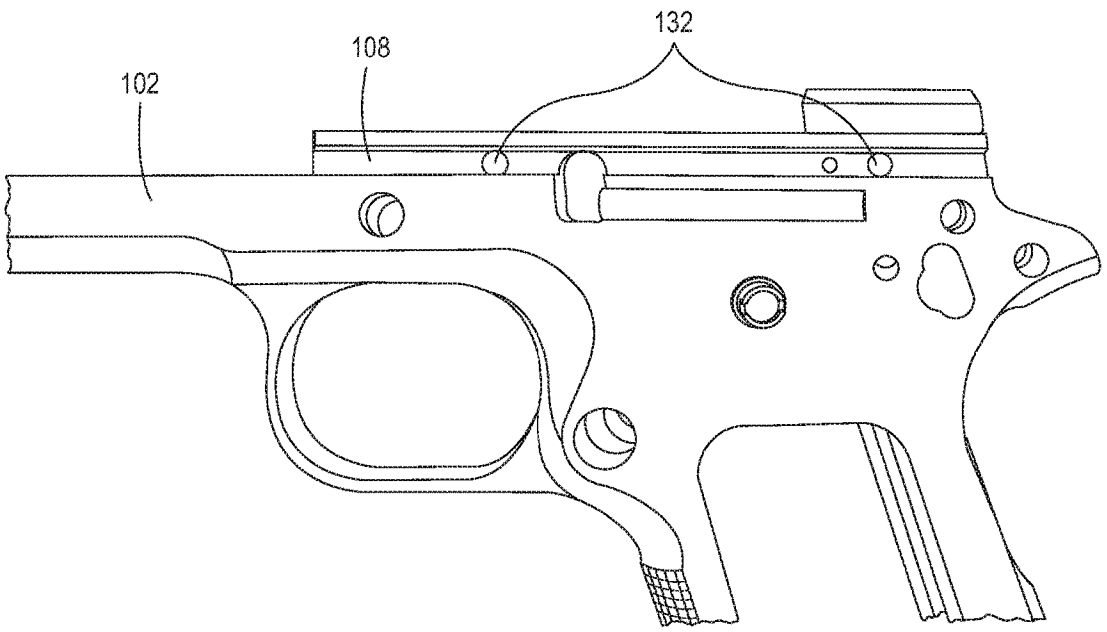
FIG. 10 is another side view of a frame of a firearm suitable for practicing exemplary embodiments of the present disclosure.

FIG. 10 depicts another side view of a frame of a firearm suitable for practicing exemplary embodiments of the present disclosure. Shown in FIG. 10 is frame 102, slide rail guide 108 and holes 132 for spacers 112.

Embodiments of the present invention have been described in detail with particular reference to particular embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A firearm assembly comprising:

(a) a frame comprising a handle and a slide rail guide, the slide rail guide comprising two parallel grooves extending through a long axis of the frame;

(b) a slide having a long axis, the slide comprising two parallel slide rails extending through the long axis of the slide, the two parallel slide rails operable for slidably engaging the two parallel grooves of the frame;

(c) a first spacer, the first spacer fixedly attached to one of a first groove of the two parallel grooves of the frame and a first slide rail of the two parallel slide rails of the slide, the first spacer operable to slideably engage a remaining one of the first groove of the two parallel grooves of the frame and the first slide rail of the two parallel slide rails of the slide, and the first spacer providing a first gap between the first slide rail and the first groove of the frame; and (d) a second spacer, the second spacer fixedly attached to one of a second groove of the two parallel grooves of the frame and a second slide rail of the two parallel slide rails of the slide, the second spacer operable to slideably engage a remaining one of the second groove of the two parallel grooves of the frame and the second slide rail of the two parallel slide rails of the slide, and the second spacer providing a second gap between the second slide rail and the second groove of the frame, wherein the first spacer and the second spacer comprise at least one pin extending through the frame perpendicular to the long axis of the frame, at least one of the first spacer and the second spacer includes a pair of pins either spaced along the long axis or extending perpendicular to the long axis.

2. The firearm assembly according to claim 1, wherein the first spacer is fixedly attached to the first groove of the frame, and the second spacer is fixedly attached to the second groove of the frame.

3. The firearm assembly according to claim 1, wherein the first spacer is fixedly attached to the first slide rail of the slide, and the second spacer is fixedly attached to the second slide rail of the slide.

4. The firearm assembly according to claim 1, wherein the first gap and the second gap provide a pair of cavities to maintain extraneous materials.

5. A method comprising:

(a) providing a frame comprising a handle and a slide rail guide, the slide rail guide comprising two parallel grooves extending through a long axis of the frame;

(b) providing a slide having a long axis, the slide comprising two parallel slide rails extending through the long axis of the slide, the two parallel slide rails operable for slidably engaging the two parallel grooves of the frame;

(c) providing a first spacer, the first spacer fixedly attached to one of a first groove of the two parallel grooves of the frame and a first slide rail of the two parallel slide rails of the slide, the first spacer operable to slideably engage a remaining one of the first groove of the two parallel grooves of the frame and the first slide rail of the two parallel slide rails of the slide, and the first spacer providing a first gap between the first slide rail and the first groove of the frame; and (d) providing a second spacer, the second spacer fixedly attached to one of a second groove of the two parallel grooves of the frame and a second slide rail of the two parallel slide rails of the slide, the second spacer operable to slideably engage a remaining one of the second groove of the two parallel grooves of the frame and the second slide rail of the two parallel slide rails of the slide, and the second spacer providing a second gap between the second slide rail and the second groove of the frame, wherein the first spacer and the second spacer comprise at least one pin extending through the frame perpendicular to the long axis of the frame, at least one of the first spacer and the second spacer includes a pair of pins either spaced along the long axis or extending perpendicular to the long axis.

6. The method according to claim 5, wherein the first spacer is fixedly attached to the first groove of the frame, and the second spacer is fixedly attached to the second groove of the frame.

7. The method according to claim 5, wherein the first spacer is fixedly attached to the first slide rail of the slide, and the second spacer is fixedly attached to the second slide rail of the slide.

8. The method according to claim 5, wherein the first gap and the second gap provide a pair of cavities to maintain extraneous materials.

* * * * *